US006996922B2

(12) United States Patent
Ryoo

(10) Patent No.: US 6,996,922 B2
(45) Date of Patent: Feb. 14, 2006

(54) JUMP SHOES

(76) Inventor: Hyun Wook Ryoo, 103-303 YouChangPressville, 759-2 Hwanggeum-Dong, Sesueong-Gu, Daegu (KR)

( * ) Notice: Subject to any disclaimer, the term of this patent is extended or adjusted under 35 U.S.C. 154(b) by 0 days.

(21) Appl. No.: 10/513,137

(22) PCT Filed: Dec. 12, 2003

(86) PCT No.: PCT/KR03/02740

§ 371 (c)(1),
(2), (4) Date: Nov. 1, 2004

(87) PCT Pub. No.: WO2005/027673

PCT Pub. Date: Mar. 31, 2005

(65) Prior Publication Data

US 2005/0204584 A1 Sep. 22, 2005

(30) Foreign Application Priority Data

Sep. 23, 2003 (KR) ..... 20-2003-0030037

(51) Int. Cl.
*A43B 13/18* (2006.01)
*A43B 3/26* (2006.01)

(52) U.S. Cl. ..... 36/7.8; 36/27; 36/28

(58) Field of Classification Search ..... 36/7.5, 36/7.8, 113, 27, 28, 38
See application file for complete search history.

(56) References Cited

U.S. PATENT DOCUMENTS 4,133,086 A * 1/1979 Brennan ..... 36/7.8
4,457,084 A * 7/1984 Horibata et al. ..... 36/7.8
5,502,901 A * 4/1996 Brown ..... 36/28
5,621,984 A * 4/1997 Hsieh ..... 36/28
5,675,915 A * 10/1997 Faughn et al. ..... 36/7.5
5,845,419 A * 12/1998 Begg ..... 36/7.8

* cited by examiner

*Primary Examiner*—Marie Patterson
(74) *Attorney, Agent, or Firm*—Mayer, Brown, Rowe & Maw LLP

(57) ABSTRACT

The present invention relates to jump shoes, at which a coil spring 40 is installed, wherein a flexible blocking member 50 is installed to fully enclose around the middle layer 20 and the bottom layer 30, a connecting band 60 is fixed to the bottom layer 30 to discharge both ends of the connecting band 60 through a discharging hole 502 formed at both sides of the blocking member 50, and fastening means such as a Velcro tape 70*a* or a buckle band 70*b* is formed at the both ends of the connecting band 60 to fasten the both ends of the fastening band 60, thereby providing a jumping function by resilient force of the coil spring, or suppressing the jumping function.

3 Claims, 7 Drawing Sheets

JUMP SHOES

TECHNICAL FIELD

The present invention relates to jump shoes and, more particularly, to jump shoes capable of enabling a user to jump using resilient force of a resilient member by installing the resilient member between a middle layer and a bottom layer of a shoe sole, and usually using by employing a fixing member for suppressing the resilient force of the resilient member.

BACKGROUND ART

Jump shoes has been invented to feel fun and thrill and to obtain an exercise effect of a lower part of the body by installing a resilient member for jumping at a lower portion of shoes to enable the jumping using resilient force of the resilient member after wearing the shoes, and various types of jump shoes has been already filed and registered as patents and utility models in many countries, or actually developed and come to a market.

However, products, which have been filed or come to a market, as shown in FIG. 7, includes a middle layer 2' formed at a lower portion of a shoe 1, a bottom layer 3' formed in alignment with the middle layer spaced apart from each other, and a resilient member such as a coil spring 4' having a resilient force installed between them, thereby enabling the user to jump by the resilient force of the resilient member installed between the middle layer and the bottom layer.

However, since the prior art jump shoes should always jump due to the resilient force of the resilient member by means of a human's weight during simple walking, though the shoes are useful in a jumping play, there is a problem that the shoes does not suppress its jumping in the case that the shoes are usually used or the jumping should be suppressed, as a result, the jump shoes are limited as only playing shoes.

In addition, since the resilient member such as the coil spring installed between the middle layer and the bottom layer is exposed to the exterior and a space between the middle layer and the bottom layer is opened, a different thing such as a stone is inserted between the middle layer and the bottom layer during the jumping play to cause an irregular jump, thereby causing injuries of ankles or other parts of a wearer and decreasing lifetime of the shoes due to damages of the middle layer and the bottom layer.

DISCLOSURE OF THE INVENTION

Therefore, the present invention is directed to provide jump shoes capable of maximizing its practical usability by enabling the user to wear the jump shoes in usual, and previously preventing an irregular jump or damages of respective parts by prohibiting an insertion of a different thing between a middle layer and a bottom layer.

According to an aspect of the present invention, there is provided jump shoes including a spring installed between a middle layer and a bottom layer of a shoe sole, a case installed to enclose the spring therein, a flexible blocking member installed between the middle layer and the bottom layer to prevent a different thing from being inserted between the middle layer and the bottom layer, and fastening means installed at the bottom layer to fasten the shoes to suppress resilient force of the resilient member, thereby enabling a usual use of the jump shoes.

BRIEF DESCRIPTION OF THE DRAWINGS

The above and other features and advantages of the present invention will become more apparent to those of ordinary skill in the art by describing in detail preferred embodiments thereof with reference to the attached drawings in which.

BEST MODE FOR CARRYING OUT THE INVENTION

Figure 1:
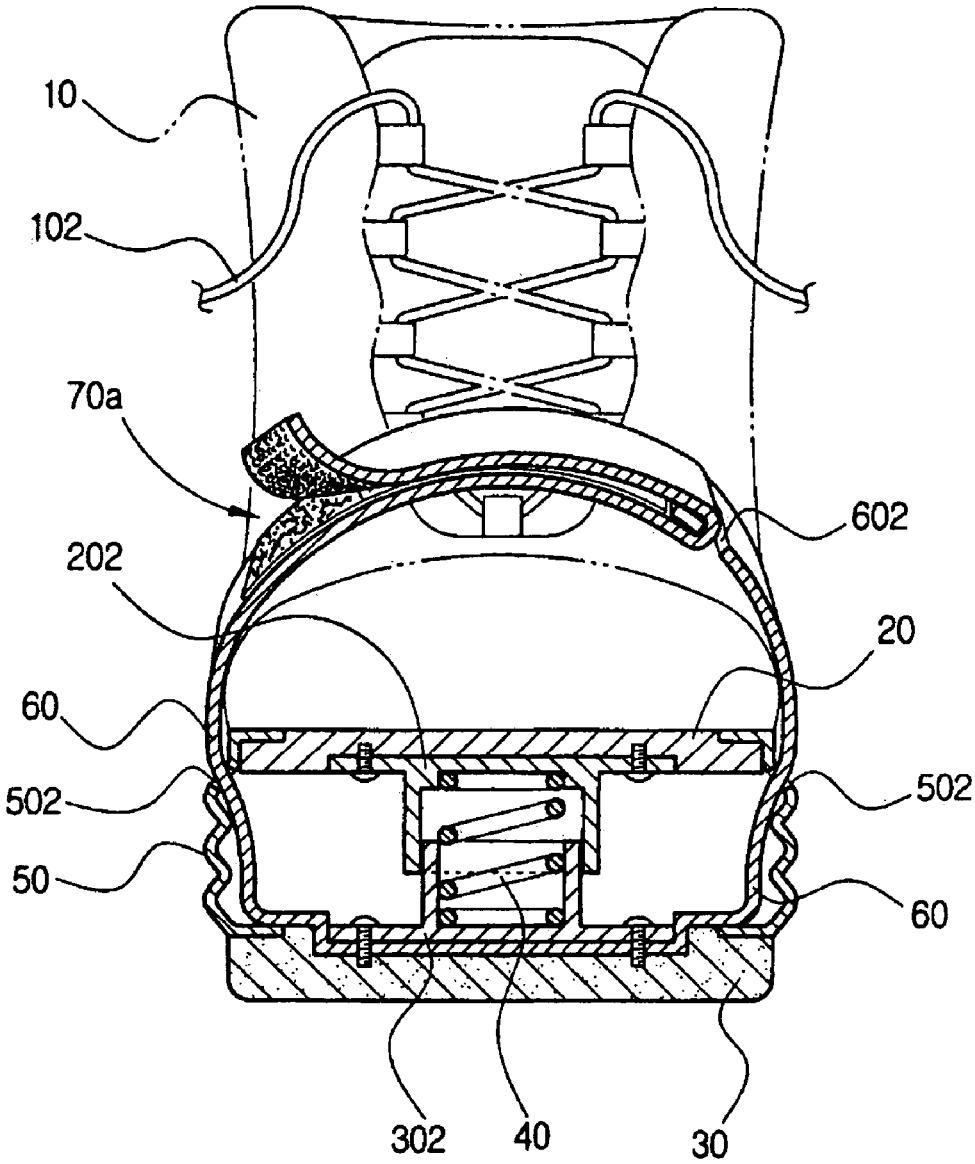
FIG. 1 is an exemplary front view of the present invention.
Figure 2:
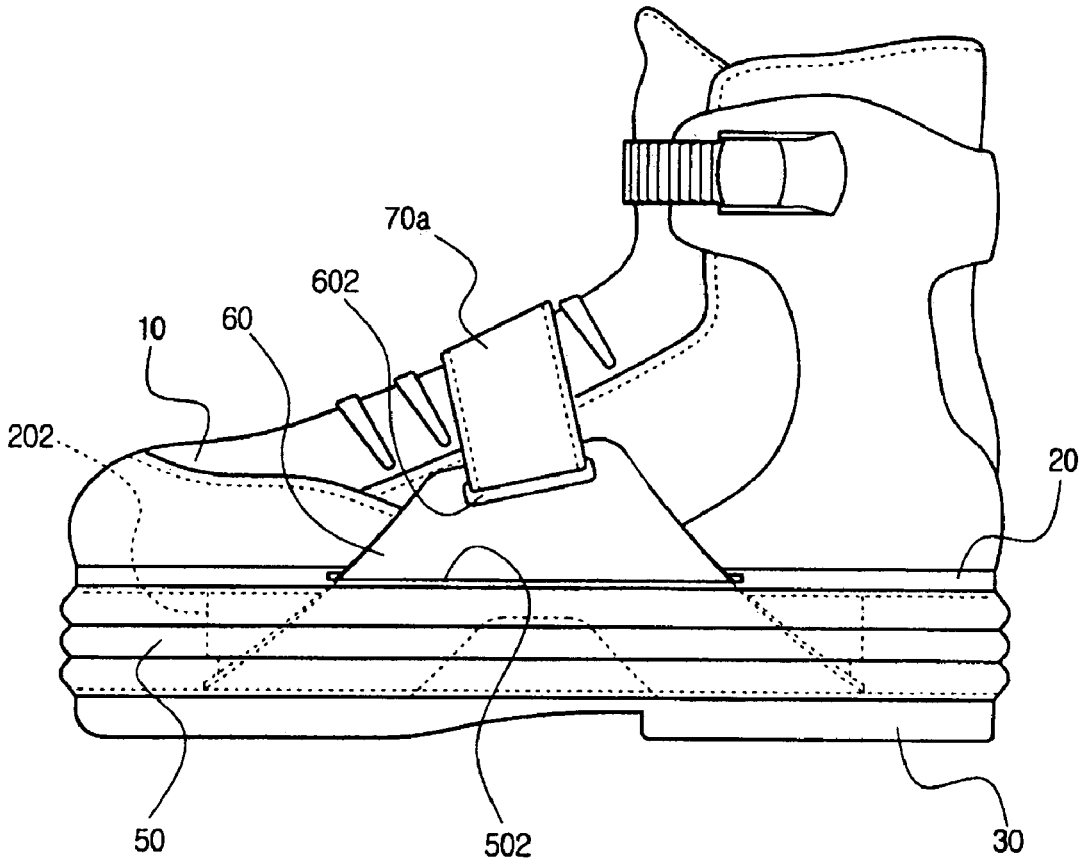
FIG. 2 is an exemplary side view of the present invention.

Jump shoes 10 comprising a middle layer 20 integrally formed with a bottom surface of the shoes 10 provided with a shoe strip 102 for fastening the shoe, a plurality of upper cases 202 having a downward-opening installed on the bottom surface, a bottom layer 30 formed at a lower portion of the middle layer 20 in parallel with the middle layer 20 spaced apart from each other, a plurality of lower cases 302 having an upward-opening installed on the top surface of the bottom layer 30, a coil spring 40 inserted between the upper case 202 and the lower case 302 inserted into each other, wherein a flexible blocking member 50 is installed to fully enclose around the middle layer 20 and the bottom layer 30, a connecting band 60 is fixed to the bottom layer 30 to discharge both ends of the connecting band 60 through a discharging hole 502 formed at both sides of the blocking member 50, and fastening means such as a Velcro tape 70*a* or a buckle band 70*b* is formed at the both ends of the connecting band 60 to fasten the both ends of the fastening band 60.

Meanwhile, the connecting band 60 is inserted to install its middle portion between the lower case 302 and the 302, and provided with the Velcro tape 70*a* formed at its one end and a connecting hole 602 formed at the other end.

Hereinafter, an exemplary embodiment of the present invention will be described in conjunction with the accompanying drawings.

First, FIG. 1 is an exemplary front view illustrating main components of the present invention, jump shoes is capable of covering an ankle of a wearer to protect the ankle of the wearer, and the shoe strip can be used to maintain a stable wearing feeling by fastening the strip at an appropriate strength.

The middle layer 20 is integrally formed with a lower portion of the shoe 10 using an adhesion method etc. to install the upper case 202 having a downward opening at the bottom surface securely using a screw etc.

In addition, the bottom layer 30 is formed at a lower portion of the middle layer in parallel therewith spaced apart from each other, the upward opened lower case 302 is securely fixed to the upper portion of the bottom layer 30 to be opposed to the upper case 202 using a screw etc., and then, the lower case 302 is inserted into the upper case 202, at this time, the coil spring 40 having a strong resilient force is installed in between the upper case 202 and the lower case 302, thereby applying the resilient force between the middle layer 20 and the bottom layer 30 of the shoe 10.

At this time, most preferably, the coil spring installed in an inner space where the upper case 202 is combined with the lower case 302 uses a compression coil spring 40, and the coil spring having various spring coefficients may be preferably used depending upon weights of users.

Meanwhile, the flexible blocking member 50 is installed around the middle layer 20 and the bottom layer 30, which are biased by the resilient force of the coil spring 40 to enclose the upper case 202 and the lower case 302 installed therein from the exterior, thereby preventing an external different thing from being inserted into a space between the middle layer 20 and the bottom layer 30.

Further, the connecting band 60 is installed at the upper portion of the bottom layer 30, preferably, which is fixed to the bottom layer 30 together with the lower case 320 using a screw fixing the lower case 302 rather than an adhesion, in order to maintain a secure installation of the connecting band 60.

The both ends of the fixed connecting band 60 are discharged through the discharging hole 502 formed at the upper portion of the blocking member 50 installed between the middle layer 20 and the bottom layer 30, the connecting band 60 being provided with the Velcro tape 70*a* at its one end and the connecting hole 602 at the other end to maintain the secure fixation to enable a strong fastening using the Velcro tape 70*a* when the Velcro tape 70*a* is inserted into the connecting hole 602 to discharge upward to be attached thereto.

Figure 3:
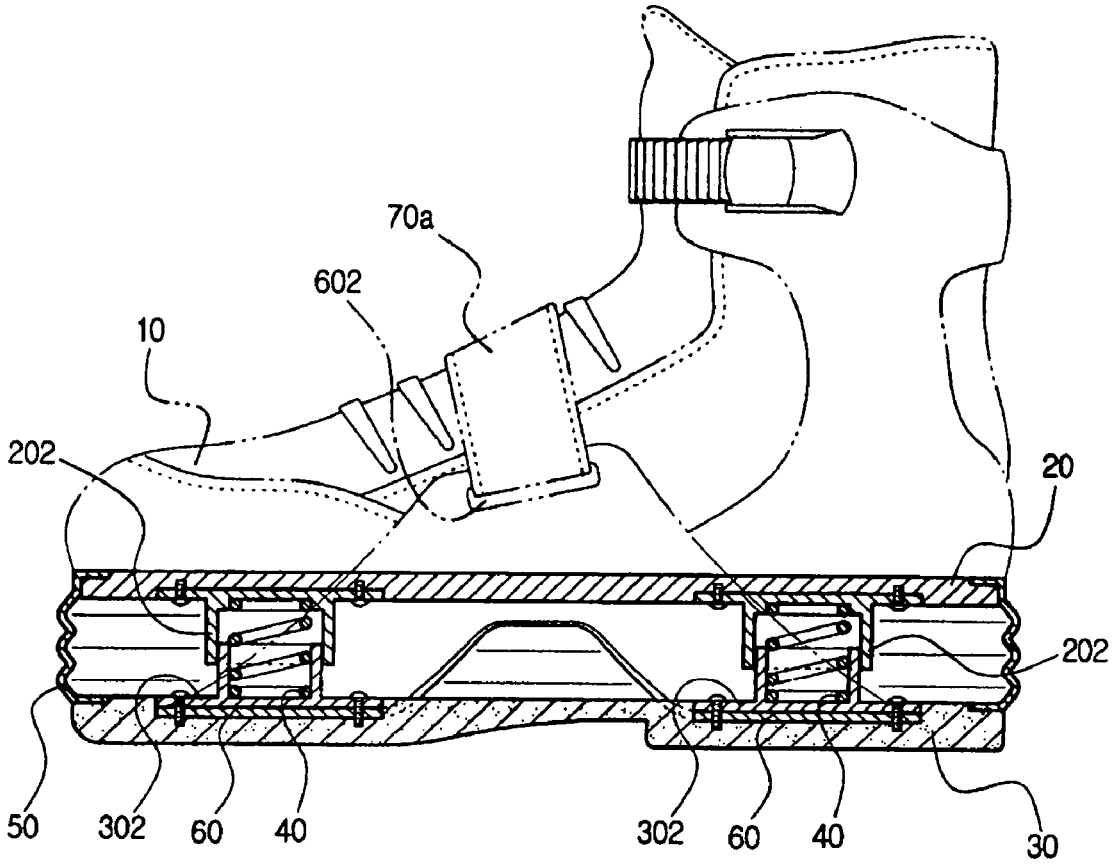
FIG. 3 is an exemplary side cross-sectional view of the present invention.
Figure 4:
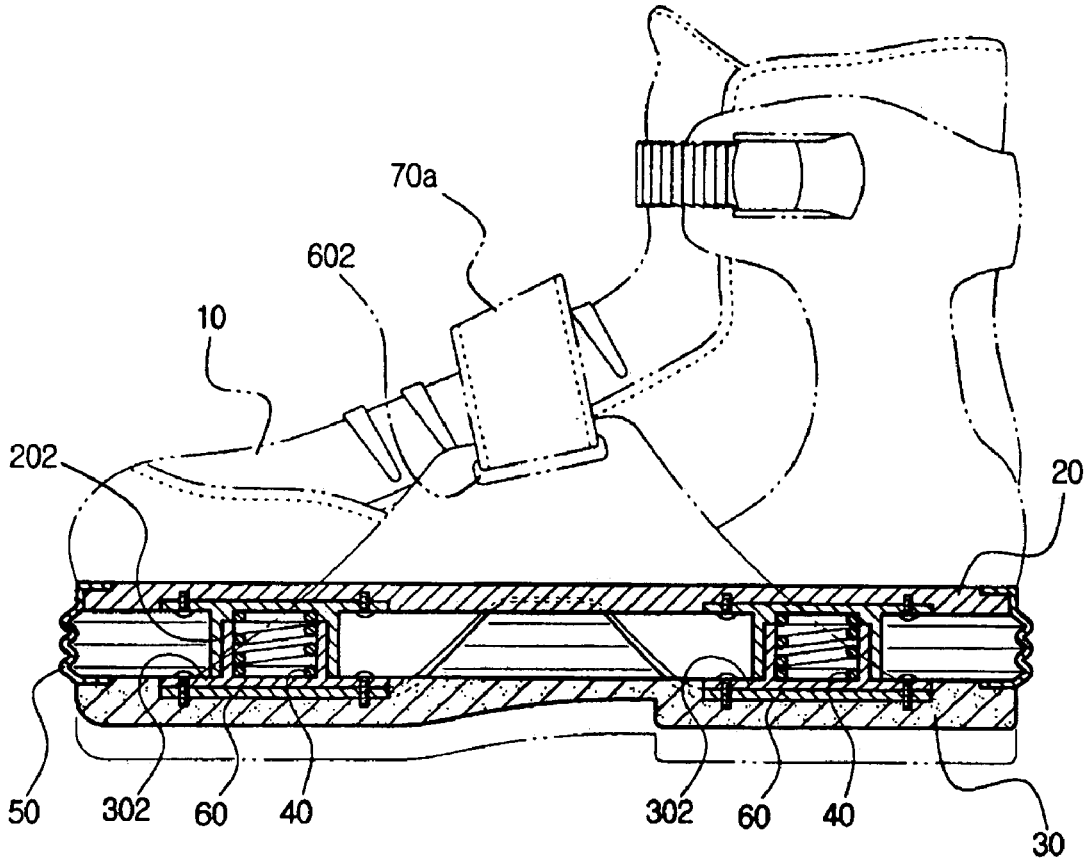
FIG. 4 is and exemplary side cross-sectional view of the present invention, of which a coil spring is compressed.

Therefore, when the user enjoys the jump shoes 10, as shown in FIG. 3, in order to press the coil spring 40 inserted between the upper case 202 installed at the middle layer 20 and the lower case 302 installed at the bottom layer 30 after the user wear the shoes, when the Velcro tape 70*a* is fastened thereto on the shoes 10 after a distance between the middle layer 20 and the bottom layer 30 is maintained, as shown in FIG. 4, the coil spring 40 is compressed and recovered to provide a jumping force to the user so that the user jumps high by the user's weight whenever the user stamps his feet.

In addition, when the user wants to suppress the jumping function by the resilient force of the coil spring 40 or to wear the jump shoes 10 for a usual use, the user maximally fasten the Velcro tape 70*a* connected to the connecting band 60 to shorten the distance between the middle layer 20 formed at the bottom surface of the shoes 10 and the bottom layer 30, at which the connecting band 60 is installed, to contact the upper case 202 installed at the bottom surface of the middle layer 20 and the lower case 302 installed at the top surface of the bottom layer 30 with each other to suppress the jumping function by the resilient force of the coil spring 40, thereby enabling the jump shoes 10 to use as conventional height-increasing shoes.

Figure 5:
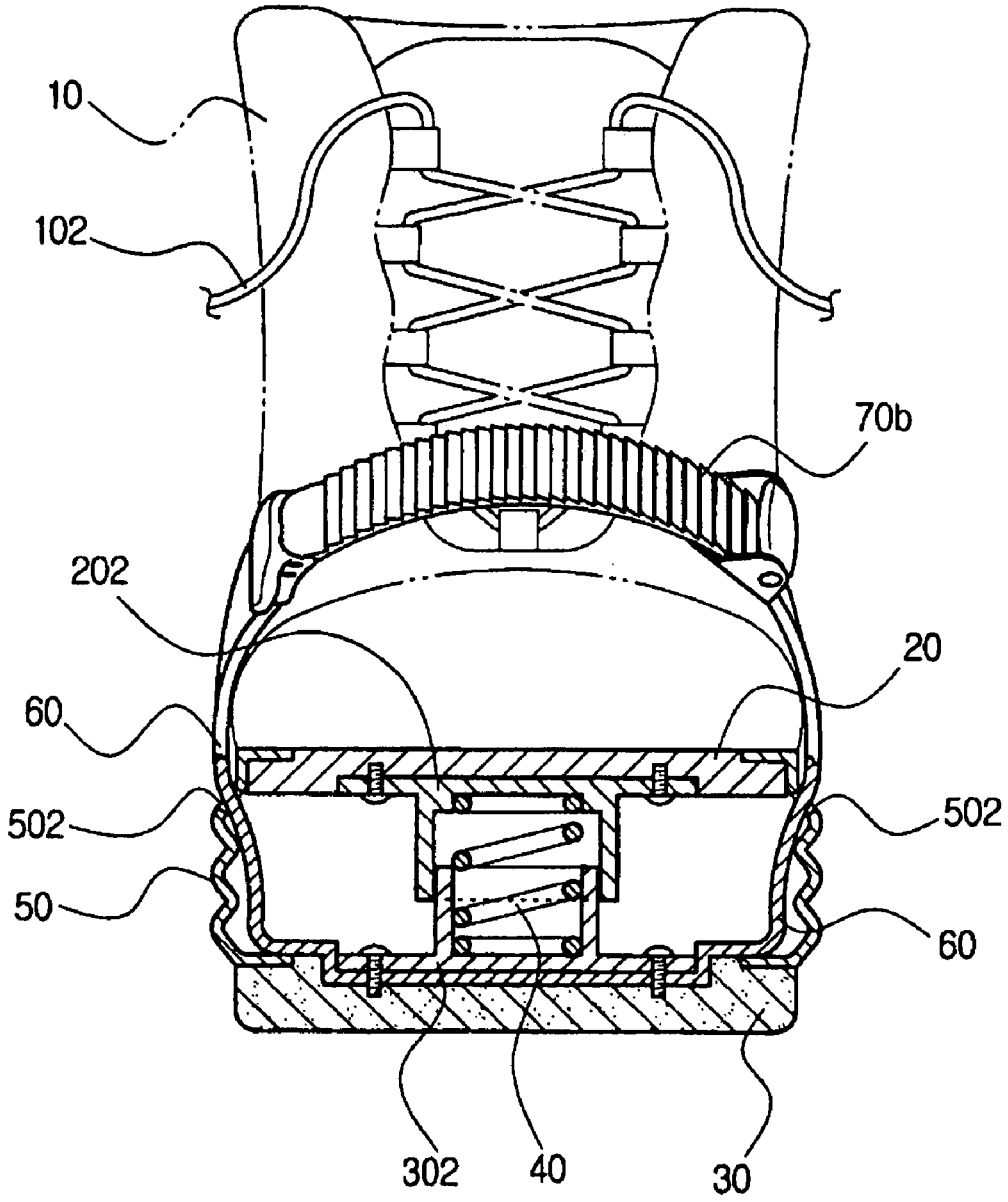
FIGS. 5 and 6 are exemplary views of another embodiment of the present invention.
Figure 6:
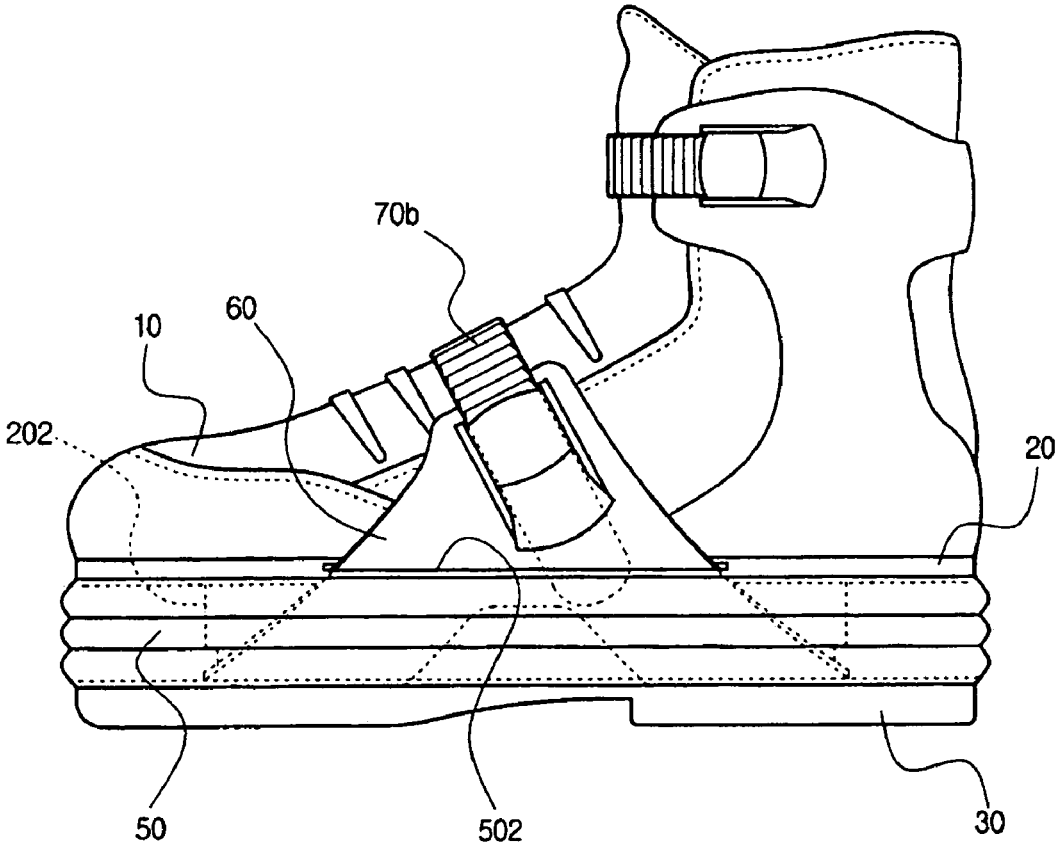
Figure 7:
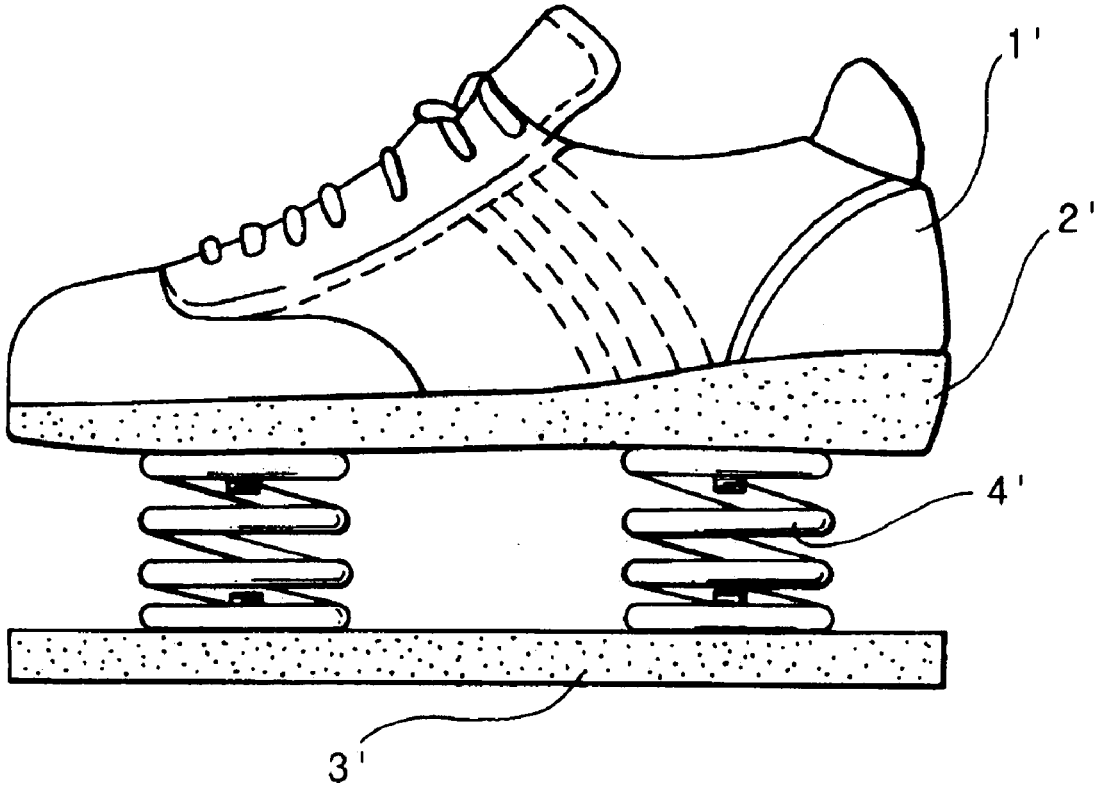
FIG. 7 is an exemplary side view of a prior art jump shoes.

FIGS. 5 and 6 show another embodiment of the present invention, and the fastening means formed at the end of the connecting band 60 employs the buckle band 70*b*, which is mainly used in a conventional inline skate. Since the buckle band 70*b* can more securely maintain the fixation than the Velcro tape 70*a*, preferably, the buckle band 70*b* is used as the fastening means when the shoes are for adults or the coil spring 40 having a high spring coefficient is used. And otherwise, various types of fastening means such as a strip, button, etc. may be applied and modified to obtain similar effects.

In addition, while the fastening means is shown to have single band, it is possible to dispose a plurality of fastening means depending upon the user's weight and shoes' size. Although the present invention is described in conjunction with the most preferable embodiment, various modifications may be applied within the scope of the present invention.

INDUSTRIAL APPLICABILITY

As can be seen from the foregoing, the present invention is capable of providing amusement for enable a user to feel fun and thrill by employing an jumping function using resilient force of a coil spring by installing the coil spring at a bottom surface of shoes, obtaining an excellent exercise effect through running or jumping, remarkably affecting growth and development of growing-up children, and conveniently using the shoes in usual since the jumping function can be suppressed depending upon user's intend, thereby providing an excellent advantage in usability and commerciality.

What is claimed is:

1. Jump shoes 10 comprising a middle layer 20 integrally formed with a bottom surface of the shoes 10 provided with a shoe strip 102 for fastening the shoe, a plurality of upper cases 202 having a downward-opening installed on the bottom surface, a bottom layer 30 formed at a lower portion of the middle layer 20 in parallel with the middle layer 20 spaced apart from each other, a plurality of lower cases 302 having an upward-opening installed on the top surface of the bottom layer 30, a coil spring 40 inserted between the upper case 202 and the lower case 302 inserted into each other, wherein a flexible blocking member 50 is installed to fully enclose around the middle layer 20 and the bottom layer 30, a connecting band 60 is fixed to the bottom layer 30 to discharge both ends of the connecting band 60 through a discharging hole 502 formed at both sides of the blocking member 50, and fastening means 70*a* and 70*b* are formed at the both ends of the connecting band 60 to fasten the both ends of the fastening band 60.

2. The jump shoes according to claim 1, wherein the connecting band is inserted between the lower case 302 and the bottom layer 30 at its center portion, the connecting band 60 being provided with a hook and loop fasters tape 70*a* at its one end and a connecting hole 602 at the other end.

3. The jump shoes according to claim 1, wherein the fastening means is a buckle band 70*b*.

* * * * *